United States Patent [19]

Meistring et al.

[11] 4,132,148

[45] Jan. 2, 1979

[54] EXPELLABLE REACTION MASS FOR RECOILLESS PROJECTILE LAUNCHERS

[75] Inventors: Rolf Meistring, Glonn; Karl Rudolf, Edelshausen; Werner Schmid, Irschenberg; Fritz Zeyher, Alpirsbach, all of Germany

[73] Assignee: Messerschmitt-Bölkow-Blohm GmbH, Germany

[21] Appl. No.: 809,677

[22] Filed: Jun. 24, 1977

[30] Foreign Application Priority Data

Jun. 30, 1976 [DE] Fed. Rep. of Germany ..... 2629282

[51] Int. Cl.[2] ..... F41F 3/02

[52] U.S. Cl. ..... 89/1.701; 89/1.704

[58] Field of Search ..... 89/1.701, 1.704, 1.7, 89/1.702, 1.703, 1.705, 1.706

[56] References Cited

U.S. PATENT DOCUMENTS

| | | | |
|---|---|---|---|
| 3,771,417 | 11/1973 | Schnabele et al. | 89/1.701 |
| 3,796,128 | 3/1974 | Zeyher | 89/1.701 |
| 4,050,351 | 9/1977 | Stauff | 89/1.701 |

FOREIGN PATENT DOCUMENTS

| | | | |
|---|---|---|---|
| 2352483 | 4/1975 | Fed. Rep. of Germany | 89/1.704 |

*Primary Examiner*—David H. Brown
*Attorney, Agent, or Firm*—McGlew and Tuttle

[57] ABSTRACT

A reaction mass for a launching tube having a centrally positioned propellant charge for propelling a missile at its forward end and a reaction mass located rearwardly of the propellant charge which is propelled at the rear end, comprises an inert, readily fragmentizing, expellable reaction mass comprising a glass material which is internally prestressed and which disintegrates at the launch. The reaction mass is advantageously in the form of a glass cylinder which is either connected to a metallic pusher member arranged rearwardly of the propellant charge which is pushed by the ignition of the charge in a rearward direction, or it may comprise a glass cylinder which includes its own pusher head formation. The pusher itself is arrested by a brake positioned at the rear exit. In addition, the rear exit is closed by a diaphragm which may shatter after ignition of the propellant charge. The reaction mass may also comprise a front pusher face which is engaged with a rear brake positioned at the rear opening or it may comprise a plurality of layers of glass held to a pusher head which is arrested at the rear opening. In still another embodiment, the glass may comprise a plurality of flat discs held together in an assembly to a pusher member.

15 Claims, 4 Drawing Figures

EXPELLABLE REACTION MASS FOR RECOILLESS PROJECTILE LAUNCHERS

FIELD AND BACKGROUND OF THE INVENTION

This invention relates in general to projectile launchers and, in particular, to a new and useful inert, expellable reaction mass for recoilless projectile launching devices.

DESCRIPTION OF THE PRIOR ART

Recoilless launchers substantially comprise a launcher tube which is open both at the front end and the rear end, and accommodates a propellant charge in the middle portion of the tube, which is placed between two pushers, a forward pusher and a rearward pusher. The high-pressure gases produced by the burning down of the propellant charge drive the projectile forwardly by means of the forward pusher and, at the same time, drives the reaction mass rearwardly by means of the rearward pusher out of the launching tube. The absence of a recoil in the system is determined by the ratio of the weight of the reaction mass to the weight of the projectile, and may be further influenced by the repartition of the gas pressure between the forward and rearward pushers, due to the equality of inequality of their surface areas.

Many readily fragmentizing materials suitable as a reaction mass are known from publications and practice, for example, water, oil, sand, paper slips, jelly-like substances, etc. The easiness of disintegration of the reaction mass at its expulsion is important to prevent damage to persons or sensitive objects present behind and in the near vicinity of the operator. In addition, the rapid fragmentation of the reaction mass is very important for concealing the launch. The visibility of the discharge fire flash itself is suppressed by the forward and rearward pushers which are intercepted within the tube by the brake rings and they close the tube hermetically to the outside.

The known materials used as reaction masses do not give results which are satisfactory in every respect. Water, oil, and other liquids have the disadvantage that they must be placed in bags, with the reaction mass running out if a bag is damaged. Difficulties are also encountered at the discharge itself, since bags which are sufficiently resistant to damage during storage and transportation do not always burst in the desired manner at the time of the launch, and are consequently ejected in relatively large pieces. The same disadvantages apply to the reaction mass "sand" and the respective packing bags. Loosely filled sand, on the other hand, is disadvantageous because it may present a high frictional force to the rearwardly driven pusher due to friction on the tube, with the result that an undesirable recoil occurs. Jelly-like reactive masses have the objectionable property of reacting disadvantageously to temperature differences which cause considerable variations of their consistency. The drawback of piled-up paper slips is that they must be very carefully packed and inserted into the tube. Also, a rupture of the packing cord at the discharge or exit from the tube is problematic.

SUMMARY OF THE INVENTION

The present invention is directed to a material for such a reaction mass which is inexpensive in substance and manufacture, unaffected by storing, resistant to aging, of relatively high specific gravity, simple to put in place and functionally suitable in any respect for recoilless projectile launchers.

In accordance with the invention, there is provided an inert reaction mass consisting of a material, particularly glass, which is internally prestressed and which disintegrates at the launch.

Commercially prestressed glass which is available, such as has been and is still used for automobile windshields in particular, bursts into very small, fragmentary pieces upon local mechanical overloading due to the high compressive strains produced in the glass surface during the prestressing operation. The internal stress is introduced into the material mainly by a thermal treatment. Chemical methods of treatment have also been used recently in which calcium ions for example have been substituted for sodium ions present in the glass surface. At the present time, however, it is possible to prestress not only the material "glass," but similar methods of treatment can also be applied to other materials, for example ceramic materials, such as, aluminum oxide.

Thus, in accordance with the invention, the well-known behavior of such materials, particularly glass, is utilized by employing them as expellable reaction masses for recoilless arms. To intensify and control the process of its disintegration, the reaction mass of prestressed material is formed into bodies with a definite wall thickness, depending on the required weight. For example, the reaction mass may take the shape of a hollow cylinder.

The disintegration of the reaction mass may be initiated by the pressure produced by the burning down of the propellant charge, because the disintegration itself, thus the fragmentation, which takes at least several hundredths of a second, occurs only after the process of combustion of the propellant charge is terminated, which process takes some thousandths of a second at most so that the reaction mass is preserved as an entirety up to a time far beyond the occurrence of the maximum acceleration. The disintegration of the reaction mass may also be brought about by a separate, external action at the end of the tube, either by a local overload caused by providing fastening means, or by providing scratches in the material or glass, or by providing pressure loads to be exerted on the correspondingly shaped reaction mass. Such a pressure load may be obtained so that the outer diameter of only the front portion of the reaction mass cylinder is slightly increased relative to the inner diameter of the rear brake ring, so that as the hollow cylinder is driven out, it is destroyed (crushed) by the brake ring.

As for the shape of the reaction mass, it should be summarily noted that beginning with the caliber of the arm and the weight of the projectile, the shape further depends on the conditions and the method of introducing the initial stress, as well as on the definite wall thickness resulting therefrom. The inventive reaction mass is an inexpensive material and its processing requires less expenditures than other materials of comparable suitability. The inventive material can also be stored for an unlimited time and its specific gravity is relatively high. It can be easily colored, so that upon expulsion, the transient or remaining traces of the fine particles are hardly visible. In addition, such a reaction mass can be shaped, in practice, to any form and put in place without great expenses. Finally, the behavior of the provided reaction mass in the launcher tube is controllable.

Accordingly, it is an object of the invention to provide a reaction mass for a launching tube which comprises an inert, readily fragmentizing, expellable reaction mass for substantial recoilless launching of a missile from the tube which is made of a material which is internally prestressed and which disintegrates at launch, particularly a glass material.

Another object of the invention is to provide a missile launching tube which comprises a tube having a forward open end and a rear open end with a missile positioned in the tube for firing at the forward end and a reaction mass positioned in the tube for discharge rearwardly of the missle and with a propellant charge disposed therebetween and wherein the reaction mass comprises a glass material.

A further object of the invention is to provide a missile launching tube and a reaction mass for a missile launching tube which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DESCRIPTION OF THE PREFERRED EMBODIMENTS

Figure 1:
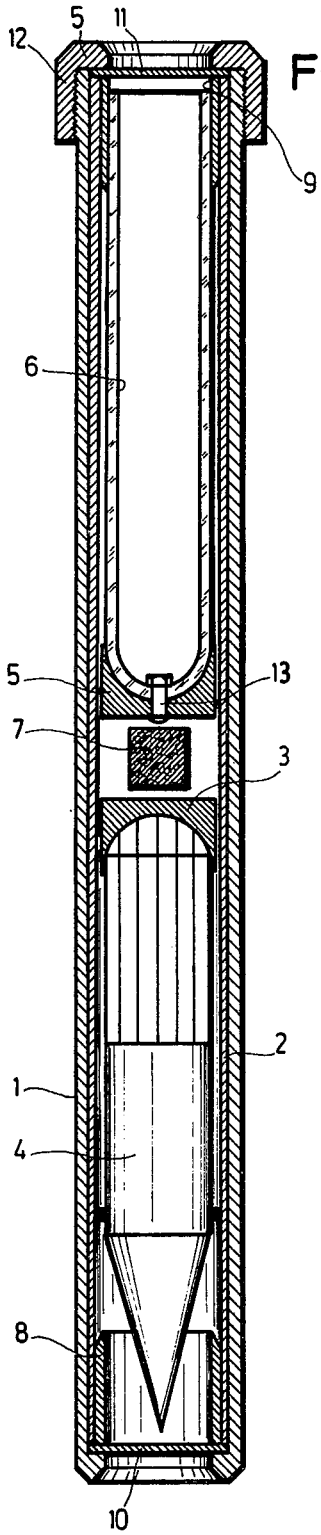
FIG. 1 is a longitudinal sectional view of a recoilless arm having a reaction mass made of a prestressed material constructed in accordance with the invention.

Referring to the drawing in particular, the invention embodied therein in FIG. 1, comprises a recoilless launching device or missile launching tube, having an inert, readily fragmentizing expellable reaction mass for substantially recoilless launching of a missile or projectile 4.

As shown in FIG. 1, the recoilless launching device comprises an external tube 1, an inner guide tube 2, a forward pusher 3 which is associated with a projectile 4, a rearward pusher 5 for driving out the reaction mass 6, a propellant charge 7 which is provided between pushers 3 and 5, a front brake ring 8, a rear brake ring 9, a front closing diaphragm 10, a rear closing diaphragm 11 and a lock nut 12.

At the launch, after the propellant charge 7 has been ignited, projectile 4 leaves the device through the front muzzle of the tube and reaction mass 6 is expelled through the rear muzzle of the tube. The two pushers 3 and 5 are intercepted by the two brake rings 8 and 9, so that the interior of tubes 1 and 2 is forwardly and rearwardly closed, and telltale fire flashes and smoke development are stopped.

Reaction mass 6 is made of an internally prestressed material, particularly glass, and has the shape of a hollow cylinder. The cylinder is firmly secured to rearward pusher 5, for example, by means of a bolt 13. As the rearward pusher 5 is intercepted by the rear brake ring 9, the great retardation forces produced at bolt 13 destroy the hollow cylinder. The cylinder disintegrates into micro-fragments which are rapidly braked in the air.

Figure 2:
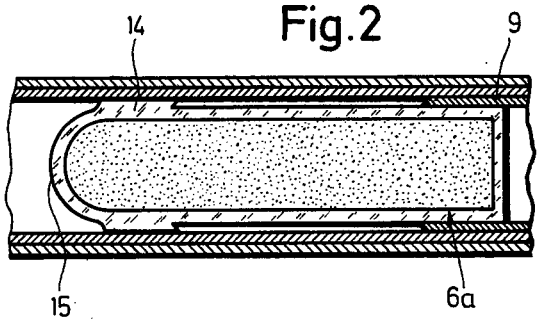
FIGS. 2, 3 and 4 are partial longitudinal sectional views of a recoilless arm similar to FIG. 1 showing different embodiments of the invention.

In FIG. 2, reaction mass 6*a* has the shape of a hollow body which is closed at its front and in the rear and is provided with a front guide ring 14. The forward front face 15 of reaction mass 6*a* performs the function of the rearward pusher. The reaction mass 6*a* is disintegrated by mechanical overstressing as the guide ring 14 impinges on rear brake ring 9.

Figure 3:
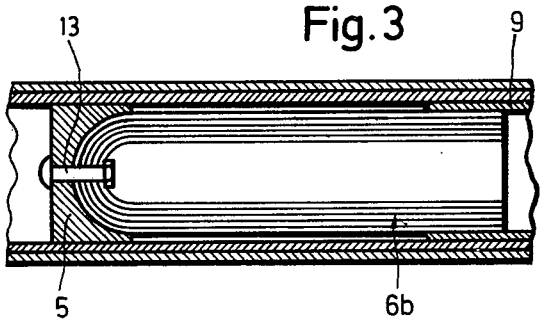

According to FIG. 3, reaction mass 6*b* comprises a plurality of individual hollow cylinders which are nested together one in the other and firmly secured to rearward pusher 5 by a bolt 13.

Figure 4:
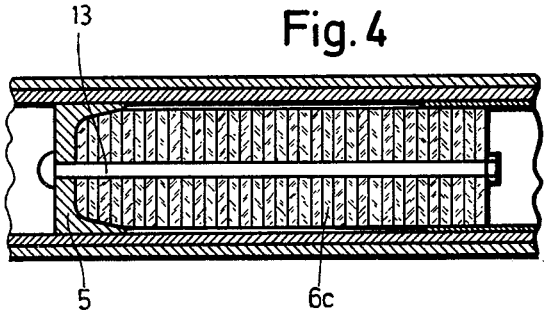

According to FIG. 4, reaction mass 6*c* comprises a plurality of discs which are also firmly secured to rearward pusher 5 by means of a bolt 13.

While specific embodiments of the invention have been shown and described in detail to illustrate the application of the principles of the invention, it will be understood that the invention may be embodied otherwise without departing from such principles.

What is claimed is:

1. A reaction mass for a launching tube having a centrally positioned propellant charge for propelling a missile out of its forward end and a reaction mass located rearwardly of the charge for discharge out of its rear end, comprising an inert, readily fragmentizing, expellable reaction mass for the substantially recoilless launching of the missile and being of a material which is internally prestressed and which disintegrates at the launch.

2. A reaction mass for a launching tube, according to claim 1, wherein said material comprises glass.

3. A reaction mass for a launching tube, according to claim 1, including means for disintegrating the mass not sooner than at its exit from the rear end of the launching tube.

4. A reaction mass for a launching tube, according to claim 1, wherein said mass comprises a hollow cylinder of glass.

5. A reaction mass for a launching tube, according to claim 1, wherein said mass comprises a hollow cylinder having at least one end closed.

6. A reaction mass for a launching tube, according to claim 1, wherein said reaction mass comprises a hollow glass cylinder filled with a flowable substance, such as water or oil, or with a granular material, such as sand.

7. A missile launching tube, comprising a tube having a forward open end and a rear open end, a missile positioned in said tube for firing out the forward end, a reaction mass positioned in said tube rearwardly of said missile for firing out the rear end, a propellant charge positioned between said reaction mass and said missile, said reaction mass comprising a prestressed glass.

8. A missile launching tube, according to claim 7, wherein said reaction mass comprises a colored material providing a camouflage.

9. A missile launching tube, according to claim 7, including forward pusher means between said projectile and the propellant charge adapted to move forward and to propel a projectile out of the forward end and rear pusher means associated with the reaction mass located rearwardly of the propellant charge, a forward brake ring disposed at the front end of the tube in a position to intercept said forward pusher means and retain it in said launching tube after the projectile is moved out, and a rear brake ring located adjacent the rear end of said launching tube in a position to intercept said rear pusher means to prevent it from exiting from said launching tube after said reaction mass moves out the rear end of said launching tube.

10. A missile launching tube, according to claim 9, wherein said reaction mass comprises a glass cylinder secured to said rear pusher means, said rear pusher means comprising a pusher member having a front piston head formation and a rear concavity engaged with said reaction mass.

11. A missile launching tube, according to claim 9, wherein said reaction mass includes a forward end comprising said rear pusher means, said forward end being engageable with said rear brake ring.

12. A missile launching tube, according to claim 9, wherein said rear pusher means comprises a piston member having a hollow rear concavity, said reaction mass comprising a plurality of layers of glass cylinders arranged in a nested interengagement and secured to said rear pusher means.

13. A missile launching tube, according to claim 9, wherein said rear pusher means includes a hollow piston, said reaction mass comprising a plurality of glass plates and means for securing said plates to said rear pusher piston.

14. A missile launching tube, according to claim 9, wherein said reaction mass comprises a cylinder member having a front closed end forming said forward pusher means, said front end having a portion of a larger diameter than said front brake ring and being interceptable by said front brake ring.

15. A missile launching tube, according to claim 14, wherein said reaction mass is filled with a flowable material.

* * * * *